US012121154B2

(12) United States Patent
Lee

(10) Patent No.: US 12,121,154 B2
(45) Date of Patent: Oct. 22, 2024

(54) ZONED SPRING MATTRESS THAT CAN BE COMPACTLY COMPRESSED, FOLDED AND ROLLED

(71) Applicant: Zinus Inc., Seongnam-si (KR)

(72) Inventor: Dong Young Lee, Busan (KR)

(73) Assignee: Zinus Inc., Tracy, CA (US)

( * ) Notice: Subject to any disclaimer, the term of this patent is extended or adjusted under 35 U.S.C. 154(b) by 558 days.

(21) Appl. No.: 16/935,196

(22) Filed: Jul. 22, 2020

(65) Prior Publication Data

US 2022/0022661 A1 Jan. 27, 2022

(51) Int. Cl.
*A47C 27/06* (2006.01)
*A47C 27/05* (2006.01)
(Continued)

(52) U.S. Cl.
CPC ..... *A47C 27/062* (2013.01); *A47C 27/053* (2013.01); *A47C 27/064* (2013.01);
(Continued)

(58) Field of Classification Search
CPC ... A47C 27/062; A47C 27/053; A47C 27/068; A47C 27/07; A47C 27/064; A47C 27/06
See application file for complete search history.

(56) References Cited

U.S. PATENT DOCUMENTS 2,681,457 A * 6/1954 Rymland ..... A47C 27/062 5/720
4,052,760 A * 10/1977 Golembeck ..... A47C 23/0433 5/248
(Continued)

FOREIGN PATENT DOCUMENTS

CN ZL200720007743.7 7/2007
CN 204838771 U 5/2015
(Continued)

OTHER PUBLICATIONS

Office action of the Chinese Patent Office dated Aug. 22, 2022, in the related Chinese patent application CN 202011393165.1 (12 pages).
(Continued)

*Primary Examiner* — Justin C Mikowski
*Assistant Examiner* — Ifeolu A Adeboyejo
(74) *Attorney, Agent, or Firm* — Imperium Patent Works; Darien K. Wallace

(57) ABSTRACT

A foldable and rollable zoned spring mattress includes a zoned spring layer with first, second and third lateral regions. The central axis of the mattress passes through the second lateral region. The first lateral region is disposed between the second lateral region and the top of the mattress, and the third lateral region is disposed between the second lateral region and the bottom of the mattress. The second lateral region includes pocket springs comprised of individual metal coils each encased in a fabric pocket. The first and third lateral regions include coils that are connected to one another by parallel rows of helical-shaped wires that are oriented perpendicular to the central axis. The mattress is compressed and then folded at its central axis at the pocket springs of the second lateral region. The compressed and folded mattress is then rolled such that the helical-shaped wires are not folded or bent.

23 Claims, 10 Drawing Sheets

(51) Int. Cl.
*A47C 27/07* (2006.01)
*B65B 5/04* (2006.01)
*B65B 63/02* (2006.01)

(52) U.S. Cl.
CPC ..... *A47C 27/07* (2013.01); *B65B 5/045* (2013.01); *B65B 63/02* (2013.01)

(56) References Cited

U.S. PATENT DOCUMENTS 4,161,046 A * 7/1979 Golembeck ..... A47C 27/062 5/248
4,711,067 A * 12/1987 Magni ..... B65B 63/02 53/116
4,790,038 A * 12/1988 Ikeda ..... A47C 27/068 5/247
4,928,337 A * 5/1990 Chauncey ..... A47C 27/001 5/722
5,040,255 A * 8/1991 Barber, Jr. ..... A47C 27/066 5/720
5,144,707 A * 9/1992 Callaway ..... A47C 27/085 5/678
5,669,087 A * 9/1997 Wells ..... A47C 27/062 267/91
5,671,492 A * 9/1997 Simon ..... A47C 27/144 5/722
5,953,778 A * 9/1999 Hiatt ..... A47C 27/001 5/722
6,092,249 A * 7/2000 Kamen ..... A47C 4/54 5/653
6,098,378 A * 8/2000 Wyatt ..... B65B 63/026 53/118
6,173,464 B1 * 1/2001 McCune ..... A47C 27/064 267/91
6,272,706 B1 * 8/2001 McCune ..... F16F 1/364 5/655.8
6,339,857 B1 * 1/2002 Clayton ..... A47C 27/062 5/655.7
6,684,435 B1 * 2/2004 Wells ..... A47C 27/062 5/248
6,813,791 B2 11/2004 Mossbeck et al. .. A47C 27/064 5/720
6,901,722 B2 * 6/2005 Dextraze ..... B65B 31/06 206/223
9,974,395 B2 * 5/2018 Pennington ..... A47C 27/064
10,206,515 B1 * 2/2019 Jewett ..... A47C 27/062
2005/0257323 A1 * 11/2005 Edling ..... B68G 9/00 5/720
2007/0017033 A1 * 1/2007 Antinori ..... A47C 23/0522 5/727
2007/0094807 A1 * 5/2007 Wells ..... A47C 27/065 5/248
2007/0204566 A1 * 9/2007 Lee ..... B65D 85/07 53/430
2008/0098533 A1 * 5/2008 Erdman ..... A47C 27/001 5/722
2009/0100606 A1 * 4/2009 An ..... A47C 27/15 5/690
2009/0193591 A1 * 8/2009 DeMoss ..... A47C 23/0522 5/716
2015/0305514 A1 * 10/2015 Kulju ..... A47C 27/05 5/727
2016/0166076 A1 * 6/2016 Mossbeck ..... A47C 27/066 297/452.5
2017/0042338 A1 * 2/2017 Yang ..... A47C 27/084
2017/0150819 A1 * 6/2017 Jones ..... A47C 7/142
2017/0190494 A1 * 7/2017 Stickler ..... B65D 33/01
2017/0340130 A1 * 11/2017 Mossbeck ..... A47C 27/066
2018/0055240 A1 * 3/2018 DeMoss ..... A47C 27/062
2018/0057200 A1 * 3/2018 Lawrie ..... A47C 23/00
2018/0303246 A1 * 10/2018 Long ..... B29C 65/4815
2019/0201261 A1 * 7/2019 Galer ..... A61G 7/05769
2019/0269251 A1 * 9/2019 Eigenmann ..... A47C 7/35
2019/0333127 A1 * 10/2019 Nolte ..... A47C 31/105
2020/0178697 A1 * 6/2020 Mantzis ..... A47C 27/064

FOREIGN PATENT DOCUMENTS

CN 104983227 A 7/2015
CN 105852516 A 5/2016
CN 209018209 U 11/2017
DE 202015106737 12/2015
EP 1603434 B1 3/2003
FR 2996742 A1 10/2011
GB 549156 A 6/1941
WO WO2019/046892 9/2017

OTHER PUBLICATIONS

Office action of the Chinese Patent Office dated Jan. 19, 2023, in the related Chinese patent application CN 202011393165.1 (12 pages).

* cited by examiner

ZONED SPRING MATTRESS THAT CAN BE COMPACTLY COMPRESSED, FOLDED AND ROLLED

TECHNICAL FIELD

The present invention relates to mattresses, and in particular to a zoned spring mattress that can be folded despite having helical lacing connecting the springs that cannot be folded.

BACKGROUND INFORMATION

In the retail sale of mattresses, an ever increasing portion of sales are made through online marketplaces that deliver the mattresses to the online customer using express package delivery services. This growth in online sales of mattresses was made possible when foam mattresses began to be compressed, folded and rolled into packaging with dimensions small enough to be handled by the logistics networks of the worldwide package delivery companies, which use delivery trucks with the driver working alone. Larger packages that do not qualify for express package delivery must be delivered by freight forwarders, which use at least two people per delivery truck and are typically prohibitively expensive for delivering mattresses in lower price categories that are purchased through online marketplaces.

Methods have also been developed to compress, fold and roll mattresses made of pocket springs, also called Marshall coils or pocketed coils. Consequently, compressed foam mattress and compressed pocket coil mattresses are commonly sold through online marketplaces. However, there are other spring mattress types that are less commonly sold through online marketplaces because they cannot be folded and rolled over all axes, and the combined length and girth dimensions of the larger queen and king sizes after being compressed and rolled (but not folded) still exceed the maximum dimensions accepted by the express package delivery companies. In addition, the cardboard packaging of larger queen and king size mattresses that cannot be folded and rolled at all axes does not fit in the standard shelf space at big box retailers, which is also a popular sales channel for mattresses in lower price categories. These spring mattress types that cannot be folded or rolled about all axes have connected coils as opposed to pocket coils. Two common types of connected coils are Bonnell springs and continuous coils.

FIG. 1 (prior art) shows the spring structure of a Bonnell knotted spring design. The Bonnell spring design has individual hour-glass shaped springs 10 that are laced together with helical wire lacing 11. The helical lacing holds the individual springs together and typically runs laterally in rows along the lower side and upper side of the springs. The spring structure typically also has a thick steel border rod 12 that frames the lower side and upper side of the springs.

FIG. 2 (prior art) shows two spring structures with a continuous coil design, in which a single piece of wire is woven into a grid network. Thus, the continuous coil design does not have separate, individual springs. Nevertheless, the spring sections of the continuous coil are laced together with lateral rows of helical wire lacing 13 along the top and bottom of the spring structure.

FIG. 3 (prior art) shows a mattress 14 with a Bonnell spring structure 15 in which the individual Bonnell springs are connected to one another by helical wires 11 arranged in parallel, lateral rows. Mattress 14 also has a thin foam layer 16 that lies over the upper surface of the Bonnell spring structure 15. A mattress cover 17 encases both the spring structure 15 and the foam layer 16. In this example, mattress 14 is a queen size mattress having a length of eighty inches and a width of sixty inches. FIG. 3 illustrates that mattress 14 can be folded or rolled about any lateral axis in which the helical wires 11 are not themselves folded or rolled. If mattress 14 is compressed and rolled up from bottom to top, a sixty-inch-long mattress roll would result in which each of the helical wires 11 remains in a linear helical form. Mattress 14 cannot be folded or rolled at any longitudinal axis because the helical wires 11 cannot themselves be folded or rolled, as they would not spring back into their linear helical form after being unfolded or unrolled. For example, although mattress 14 could be folded at its central lateral axis after being compressed, the resulting folded mattress could not then also be rolled about a longitudinal rolling axis that is perpendicular to the helical wires 11. Thus, the longest dimension of the packaging would remain at sixty inches, such that the combined length of girth of the packaging would exceed the maximum length and girth restrictions of packaging accepted by some express package delivery companies. In addition, the 60-inch length of the mattress packaging does not fit in the standard shelf height of big box retailers. The longest length of the packaging for a king size compressed and rolled mattress with connected coils would be even longer, such that the combined length of girth of the packaging would also exceed the length and girth restrictions of most package delivery companies.

A method is sought for folding and rolling a queen or king size mattress having a connected coil spring design such that the mattress packaging has smaller dimensions better suited to express package delivery systems and standard shelving of discount retailers.

SUMMARY

A foldable and rollable zoned spring mattress includes a zoned spring layer, an upper foam layer and a mattress cover. The lower side of the upper foam layer is adjacent to the upper side of the zoned spring layer. The zoned spring layer has a first lateral region, a second lateral region and a third lateral region. The central lateral axis of the mattress passes through the second lateral region. The first lateral region is disposed between the second lateral region and the top of the mattress, and the third lateral region is disposed between the second lateral region and the bottom of the mattress. The second lateral region includes individual pocket coils each encased in fabric. The first lateral region and the third lateral region include connected coils that are connected to one another by parallel rows of helical-shaped wires that run along the upper and lower surfaces of the first and third regions. The helical-shaped wires are oriented within the first lateral region and the third lateral region longitudinally from the top to the bottom of the mattress.

In one embodiment, the zoned spring mattress is queen sized and is eighty inches long and sixty inches wide. The first, second and third lateral regions each has a width of sixty inches. The first lateral region is at least twenty inches long, and the third lateral region is at least thirty inches long. The zoned spring mattress can be compressed and folded at its central axis. The compressed and folded mattress is then rolled to form a mattress roll that is about forty inches tall. The mattress roll can be packaged in the packing box that has a height of about forty inches, which can be placed upright in the standard shelving of big-box, discount retailers.

In another embodiment, a foldable and rollable zoned spring mattress includes a zoned spring layer with first, second and third lateral regions. The central axis of the mattress passes through the second lateral region. The first lateral region is disposed between the second lateral region and the top of the mattress, and the third lateral region is disposed between the second lateral region and the bottom of the mattress. The second lateral region includes pocket springs comprised of individual metal coils each encased in a fabric pocket. The first and third lateral regions include coils that are connected to one another by parallel rows of helical-shaped wires that are oriented longitudinally in the mattress. The mattress is compressed and then folded at its central axis at the pocket springs of the second lateral region. The compressed and folded mattress is then rolled such that the helical-shaped wires are not folded or bent but remain linear.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 4:
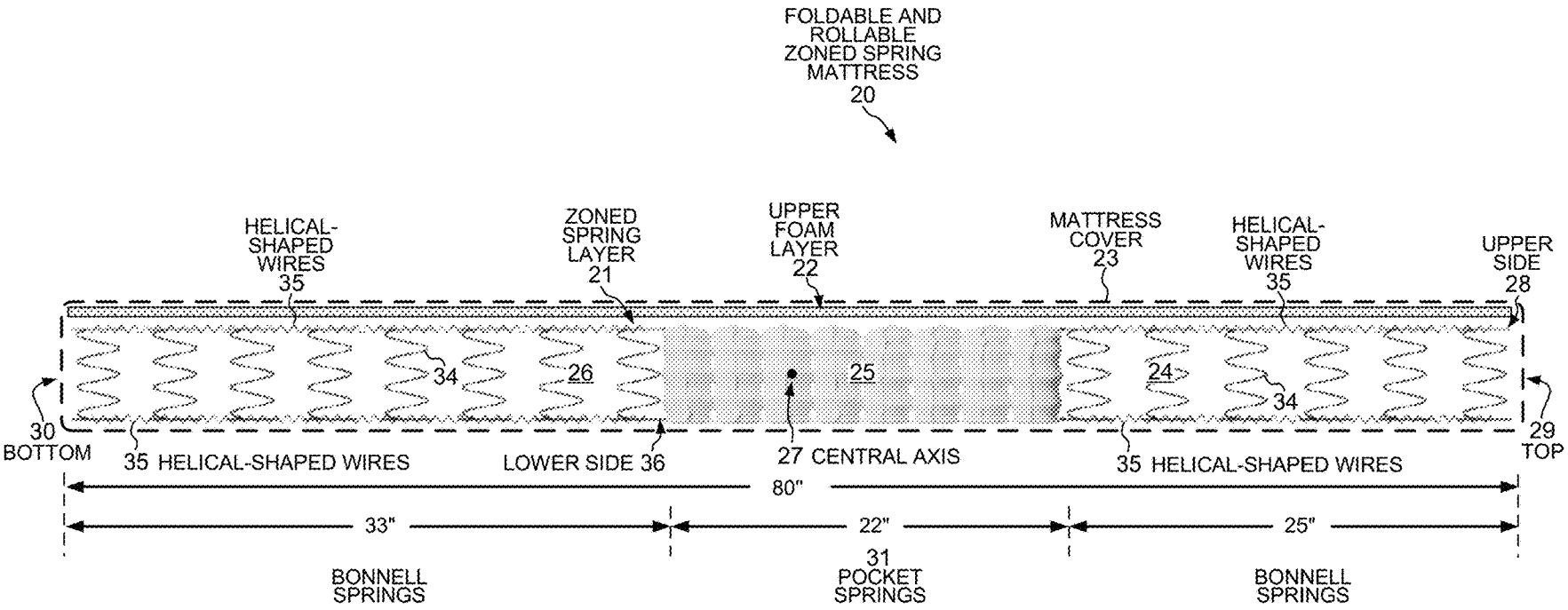
FIG. 4 is a cross-sectional view of a foldable and rollable zoned spring mattress of the present invention.

FIG. 4 is a cross-sectional schematic view of a foldable and rollable zoned spring mattress 20 of the present invention. Mattress 20 includes a zoned spring layer 21, and upper foam layer 22 and a mattress cover 23. Mattress cover 23 encloses upper foam layer 22 and zoned spring layer 21. Zoned spring layer 21 has a first lateral region 24, a second lateral region 25 and a third lateral region 26. A central axis 27 passes through second lateral region 25 in a lateral direction orthogonal to the plane of the page. The upper side 28 of zoned spring layer 21 is adjacent to the lower side of upper foam layer 22.

This embodiment of zoned spring mattress 20 is a queen size mattress having a length of eighty inches from the top 29 of the mattress to the bottom 30 of the mattress. Mattress 20 measures sixty inches in the lateral dimension. First lateral region 24 is disposed between second lateral region 25 and the top 29 of the mattress 20. First lateral region 24 has a lateral length of sixty inches and a longitudinal width of twenty-five inches. Third lateral region 26 is disposed between second lateral region 25 and the bottom 30 of the mattress 20. Third lateral region 26 has a lateral length of sixty inches and a longitudinal width of thirty-three inches. Second lateral region 25 has a lateral length of sixty inches and a longitudinal width of twenty-two inches. In another embodiment, first lateral region 24 has a longitudinal width of twenty-four inches (as opposed to twenty-five), and zoned spring layer 21 has a length of seventy-nine inches. This allows mattress cover 23 to be thicker and to add an inch to the length of the mattress so that zoned spring mattress 20 still has a length of eighty inches.

Figure 1:
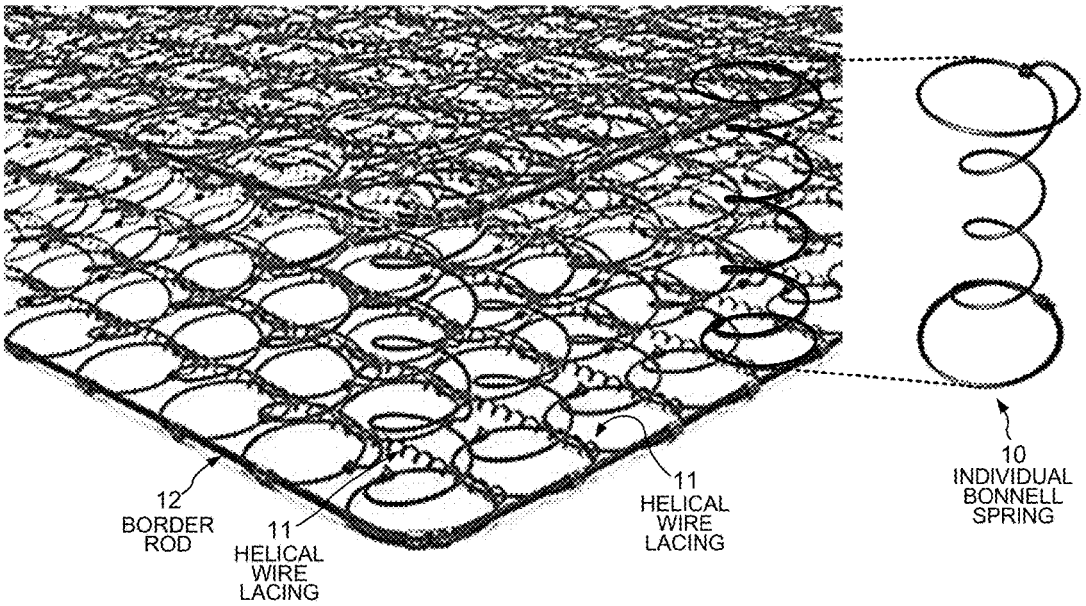
(PRIOR ART) FIG. 1
FIG. 1 (prior art) shows the spring structure of a Bonnell knotted spring design.
Figure 2:
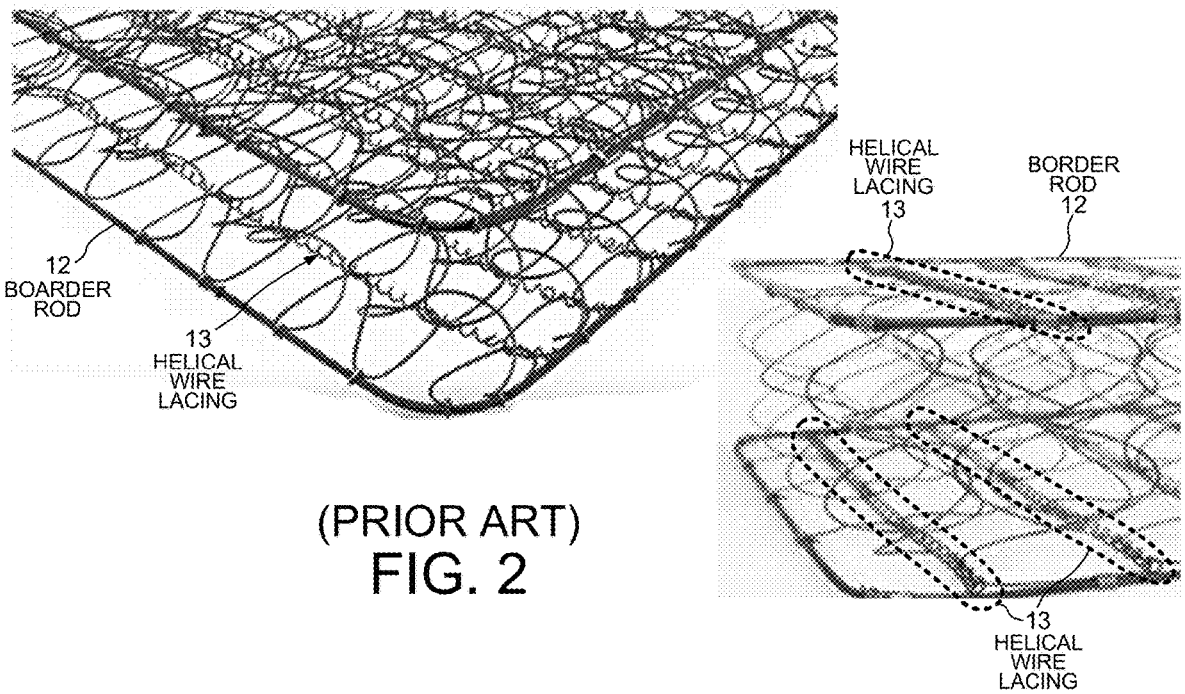
(PRIOR ART) FIG. 2
FIG. 2 (prior art) shows the spring structure of a continuous coil design.
Figure 3:
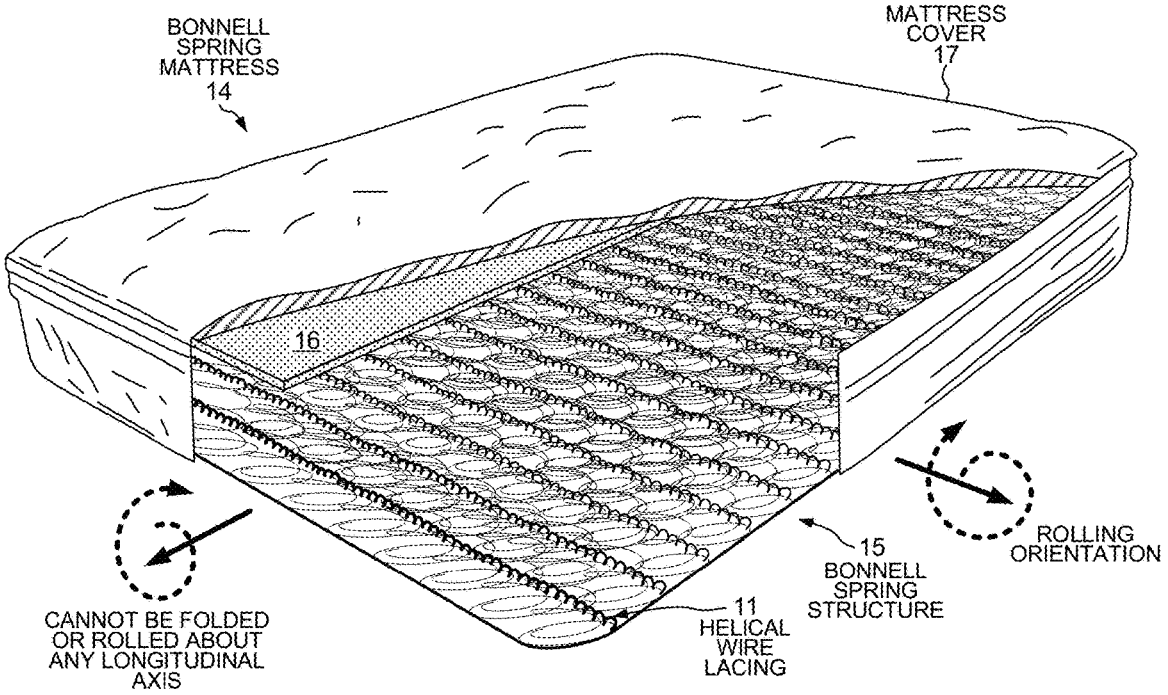
(PRIOR ART) FIG. 3
FIG. 3 (prior art) is a cut-away perspective view of a Bonnell spring mattress that cannot be folded or rolled about any longitudinal axis.
Figure 5:
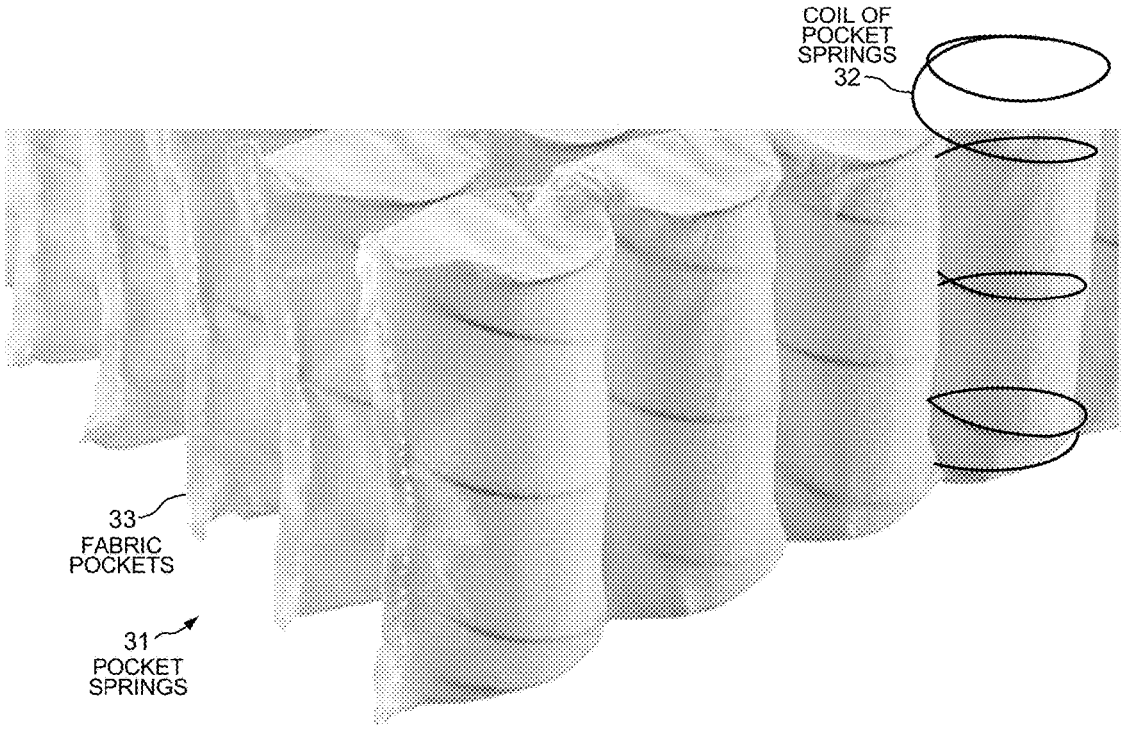
FIG. 5 shows pocket springs of the type included in middle lateral region of the zoned spring mattress of FIG. 4.

Second lateral region 25 is composed of pocket springs that include individual metal coils each enclosed in a fabric pocket. FIG. 5 illustrates pocket springs 31 of the type included in second lateral region 25 that are made up of metal coils 32 individually encased in fabric pockets 33. First lateral region 24 and third lateral region 26 include connected coils 34 that are connected to one another by helical-shaped wires 35. The helical-shaped wires 35 are oriented within first lateral region 24 and third lateral region 26 longitudinally from the top 29 to the bottom 30 of mattress 20. Parallel rows of helical-shaped wires 35 connect the coils 34 both at the upper side 28 of the springs and at the lower side 36 of the springs. The helical-shaped wires 35 are not as elastic as the wire of the connected coils 34 and do not recover when folded or bent by more than a few degrees.

In this embodiment, the metal coils 32 of second lateral region 25 are made of wire with a diameter of 2.0 millimeters or less, and the coils 34 of first lateral region 24 and third lateral region 26 are made of wire with a diameter of 2.2 millimeters or more. For example, in an alternate embodiment, the metal coils 32 of second lateral region 25 are made of wire having a diameter of 1.8 millimeters, and the coils 34 of first lateral region 24 and third lateral region 26 are made of wire with a diameter of 2.3 millimeters. In this embodiment, the coils 34 are individual Bonnell springs. In yet another embodiment, the coils 34 have a continuous coil design that does not have separate, individual springs. The spring sections of the continuous coils, however, are also laced together with rows of helical-shaped wires 35 along the top and bottom of the spring structure. Depending on the manufacturing process, connected coils are less expensive to manufacture than are pocket springs. Continuous coils are especially inexpensive to manufacture. Thus, a zoned spring layer that has only one zone of pocket springs and the remainder connected coils is less expensive to manufacture than a spring mattress made entirely of pocket springs.

Figure 6:
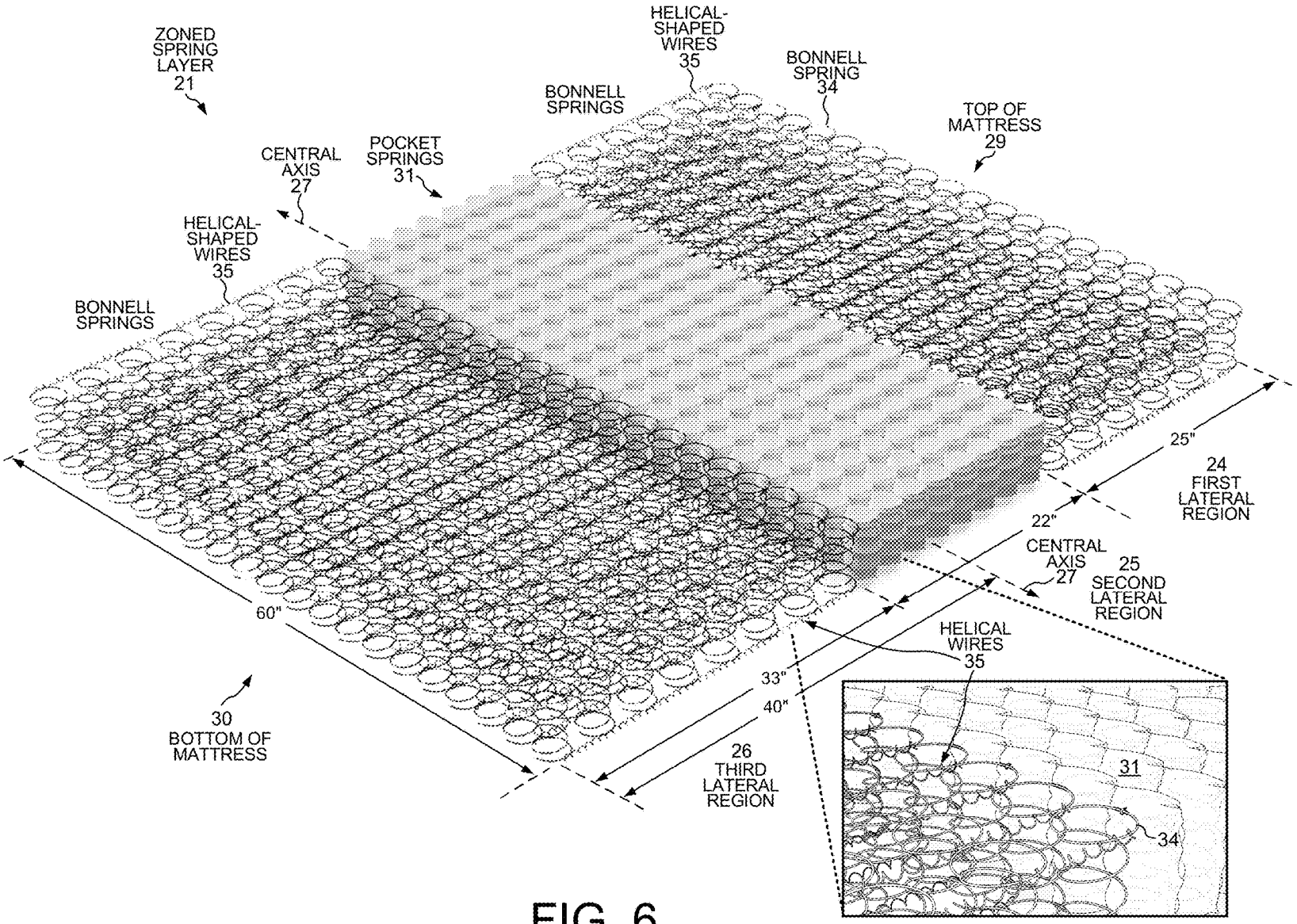
FIG. 6 is a perspective view of a zoned spring layer of the zoned spring mattress of FIG. 4.

FIG. 6 is a perspective view of zoned spring layer 21. FIG. 6 shows second lateral region 25 comprised of individual coils 34 each enclosed in a fabric pocket 33. Central axis 27 is shown passing laterally through second lateral region 25 half way between the top 29 and the bottom 30 of mattress 20. First and third lateral regions 24, 26 include coils 34 that are connected to one another by helical-shaped wires 35. The helical-shaped wires 35 are arranged in parallel rows in the first and third lateral regions oriented longitudinally from top 29 to bottom 30 of mattress 20. For each of the first and third lateral regions 24, 26, there are an upper set of parallel rows of helical-shaped wires 35 at the upper surface of the springs 34 and a lower set of parallel rows of helical-shaped wires 35 at the lower surface of the springs 34.

FIG. 6 shows zoned spring layer 21 in a decompressed state. In a compressed state when mattress 20 is vacuum sealed in an airtight wrapper, the coils are collapsed, and the upper rows of helical-shaped wires 35 are pressed closer to the lower rows of helical-shaped wires 35. The coils 32 of the pocket springs 31 of second lateral region 25 are also collapsed in the compressed state. In the compressed state, the top half of zoned spring layer 21 can be folded at the central axis 27 over the bottom half of zoned spring layer 21 without folding or bending the helical-shaped wires 35. After the top half is folded over the bottom half, all of the helical-shaped wires 35 remain parallel to one another oriented longitudinally. The compressed and folded zoned spring layer 21 can then be rolled about a longitudinal axis without folding or bending the helical-shaped wires 35. If the helical-shaped wires 35 are folded or bent in the compressed, packaged state, they will not completely unfold into linear helical-shaped wires 35 when mattress 20 is unpacked and decompressed. However, the pocket springs 31 of second lateral region 25 will completely expand when mattress 20 is unpacked and decompressed, even where zoned spring layer 21 was folded at the central axis 27. The maximum bending force at the fold is absorbed by the fabric 33 of the pocket springs 31 as opposed to by the metal of the coils 32. The coils 32 remain unbent in their collapsed state even near the fold of the zoned spring layer 21.

Figure 7:
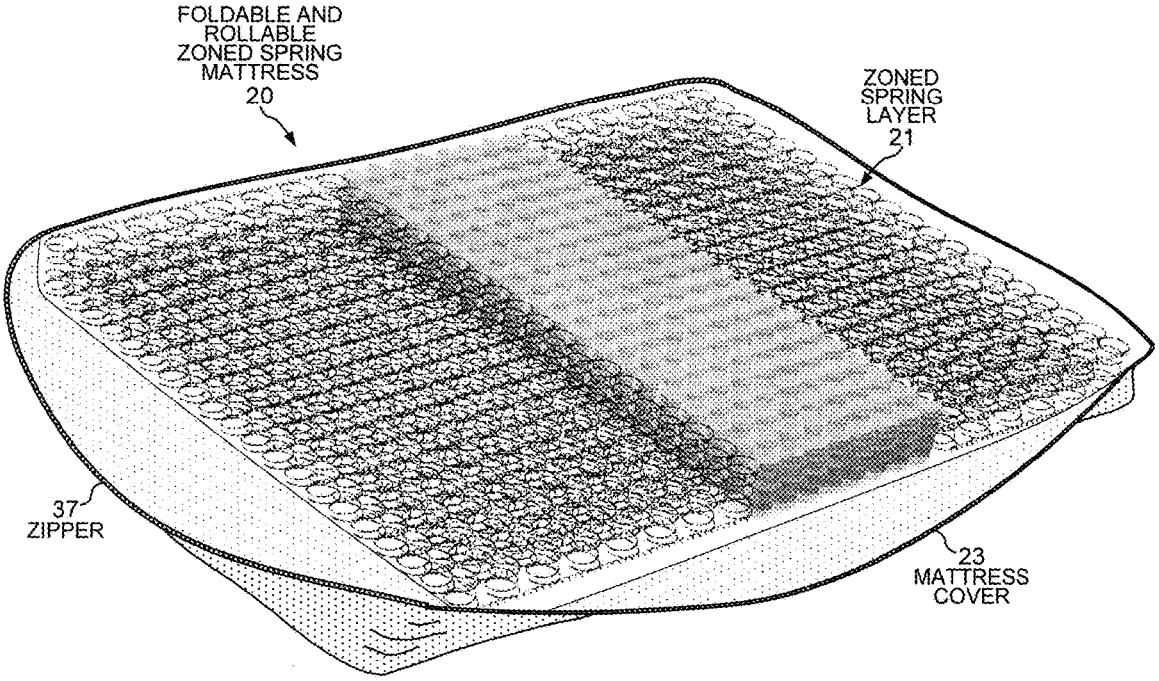
FIG. 7 is a perspective view of the zoned spring mattress of FIG. 4 with the zoned spring layer in the lower portion of a mattress cover.

FIG. 7 is a perspective view of foldable and rollable zoned spring mattress 20 with zoned spring layer 21 contained in the lower portion of mattress cover 23. This embodiment of mattress 20 does not have a separate upper foam layer over zoned spring layer 21. Instead, upper foam layer 22 is incorporated into the upper portion of mattress cover 23, for example, through quilt stitching. The upper portion of mattress cover 23 is attached to the lower portion by a zipper 37.

Figure 8:
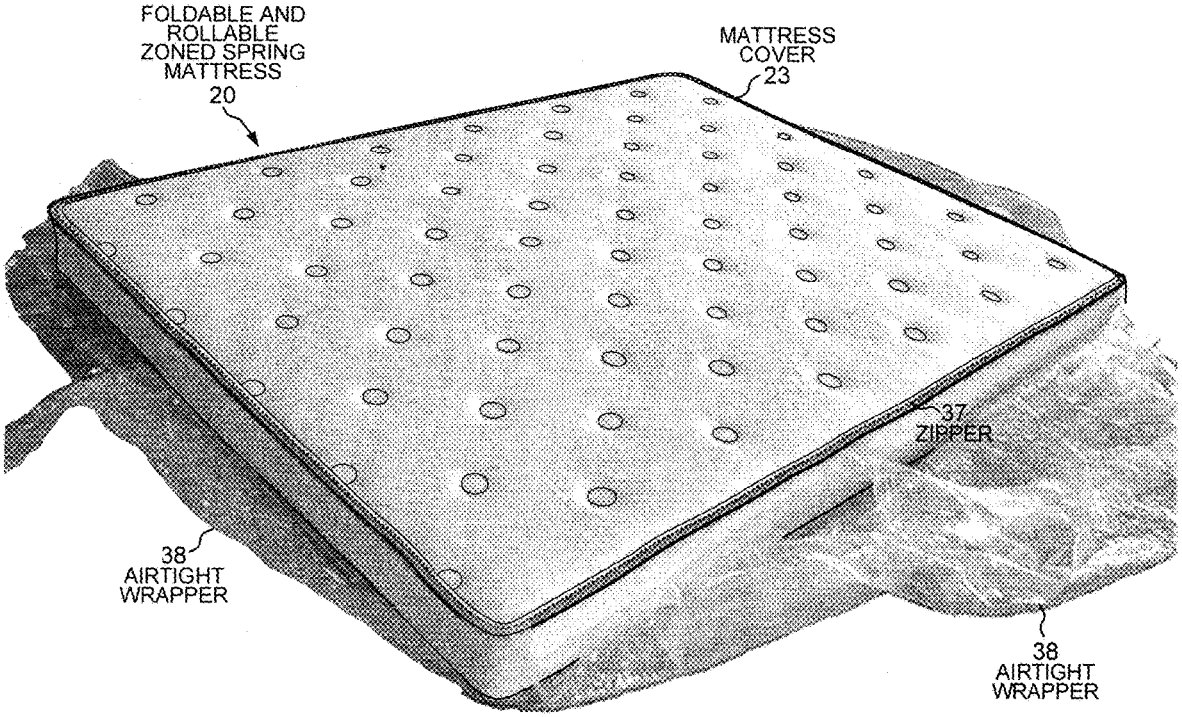
FIG. 8 is a perspective view of the zoned spring mattress of FIG. 4 in a decompressed state after the mattress has been unrolled, unfolded, removed from its airtight wrapper and allowed to expand.

FIG. 8 is a perspective view of foldable and rollable zoned spring mattress 20 in a decompressed state after mattress 20 has been unrolled, unfolded, removed from its airtight wrapper 38, and allowed to expand. Upper foam layer 22 is incorporated into the quilted top of mattress cover 23.

Figure 9:
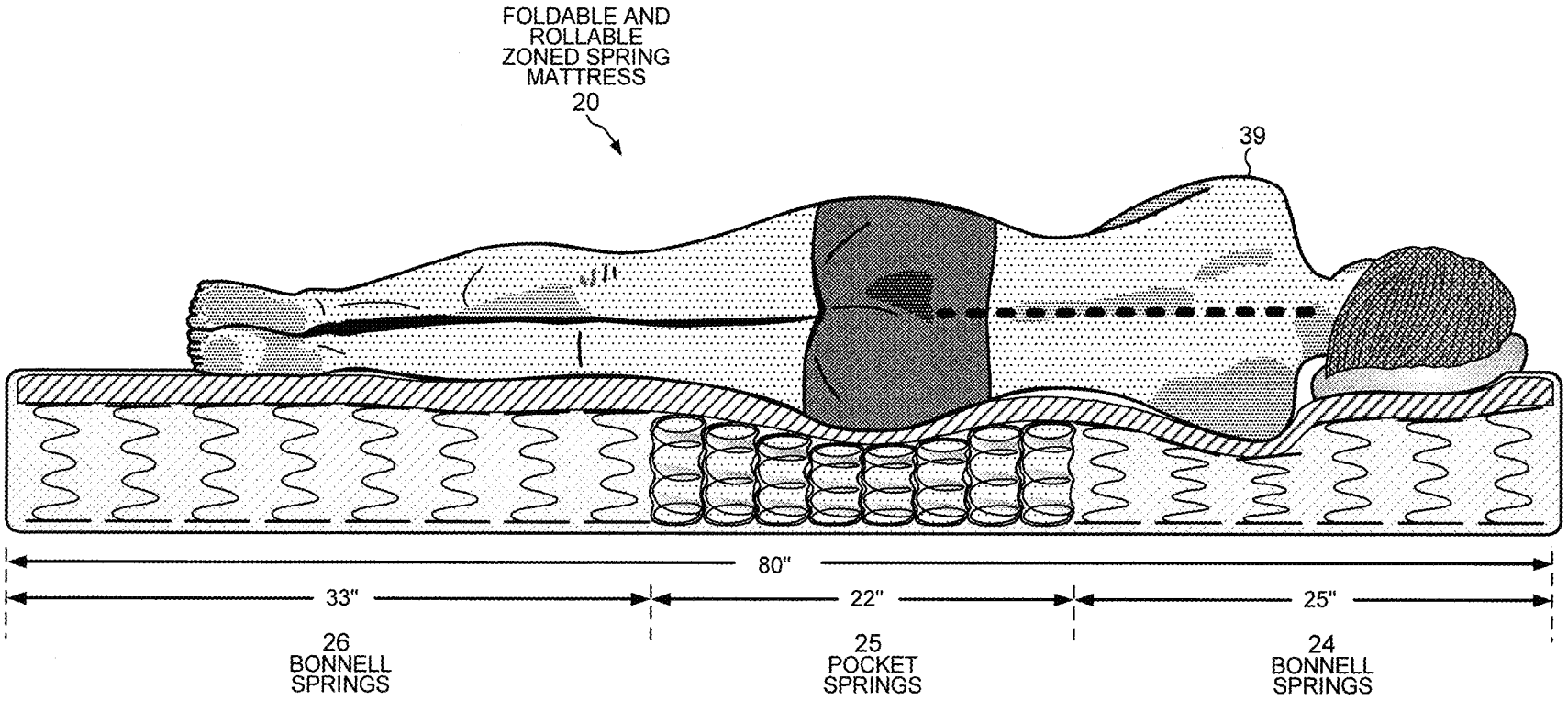
FIG. 9 is a cross-sectional view of the zoned spring mattress of FIG. 4 on which a user is lying.

FIG. 9 is a cross-sectional view of zoned spring mattress 20 on which a user 39 is lying. FIG. 9 illustrates how positioning the pocket springs 31 of second lateral region 25 at the hip location permits the user's spine to remain straight when the hips sink farther into the mattress 20. The smaller gauge coils 32 of the pocket springs 31 allow the user's hips to depress into the mattress. A straight side-lying spinal alignment of the user 39 maintains the spine in a straight line from head to legs. Mattress 20 is configured to provide optimum support for the largest percentage of users. Thus, the softer second lateral region 25 is not centered on the central axis 27 but rather is shifted towards the top 29 of the mattress 20 so as to be centered under the hips of the average user.

Figure 10:
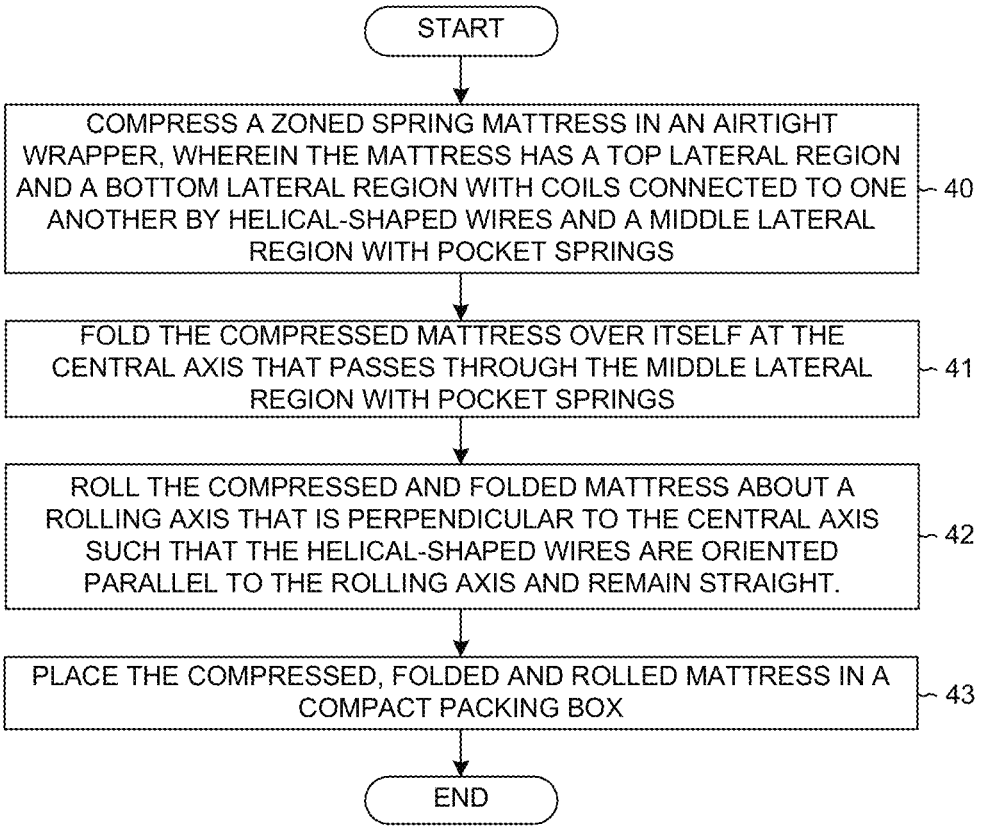
FIG. 10 is a flowchart of steps of a method of packaging the zoned spring mattress of FIG. 4 into a compact form that fits in the standard shelving of discount retailers.
Figure 11:
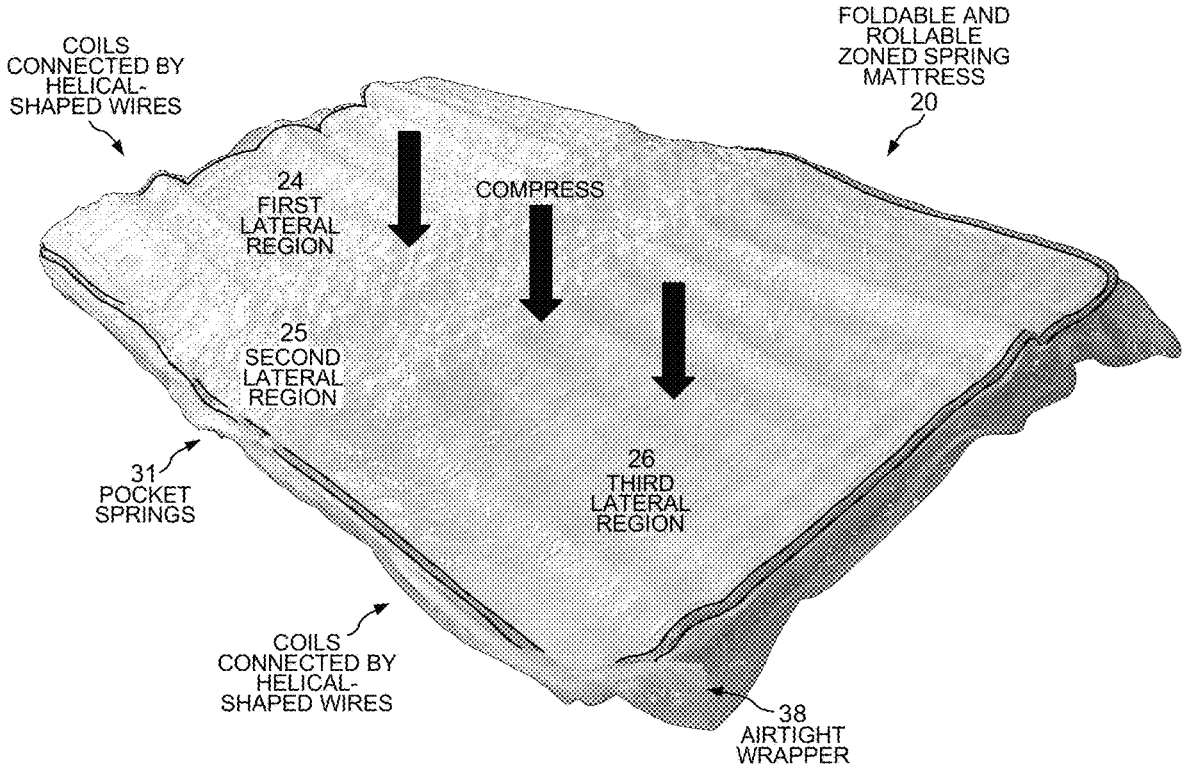
FIG. 11 shows the zoned spring mattress of FIG. 4 after it has been compressed in an airtight wrapper.

FIG. 10 is a flowchart illustrating steps 40-44 of a method of packaging zoned spring mattress 20 into a compact form better suited to standard shelving of discount retailers and to transportation by express package delivery services. In a first step 40, a mattress 20 is compressed that has a zoned spring layer 21 such that air is removed from an airtight wrapper 38 surrounding the mattress 20 as the mattress is compressed. Mattress 20 does not expand as long as the airtight seal of wrapper 38 is not broken. The compression step 40 is illustrated by FIG. 11. Zoned spring layer 21 has a first lateral region 24, a second lateral region 25 and a third lateral region 26. A central axis 27 passes laterally through second lateral region 25. First lateral region 24 is disposed between second lateral region 25 and the top 29 of mattress 20. Third lateral region 26 is disposed between second lateral region 25 and the bottom 30 of mattress 20. Second lateral region 25 includes pocket springs 31 comprised of individual metal coils 32 each encased in fabric pockets 33. First lateral region 24 and third lateral region 26 include coils 34 that are connected to one another by helical-shaped wires 35. The helical-shaped wires 35 are arranged only within the first and third lateral regions longitudinally from the top 29 to the bottom 30 of mattress 20. In one embodiment, the coils 34 are Bonnell springs that are connected to one another by helical-shaped wires 35. In another embodiment, coil sections of continuous coils are connected to one another by helical-shaped wires 35.

Figure 12:
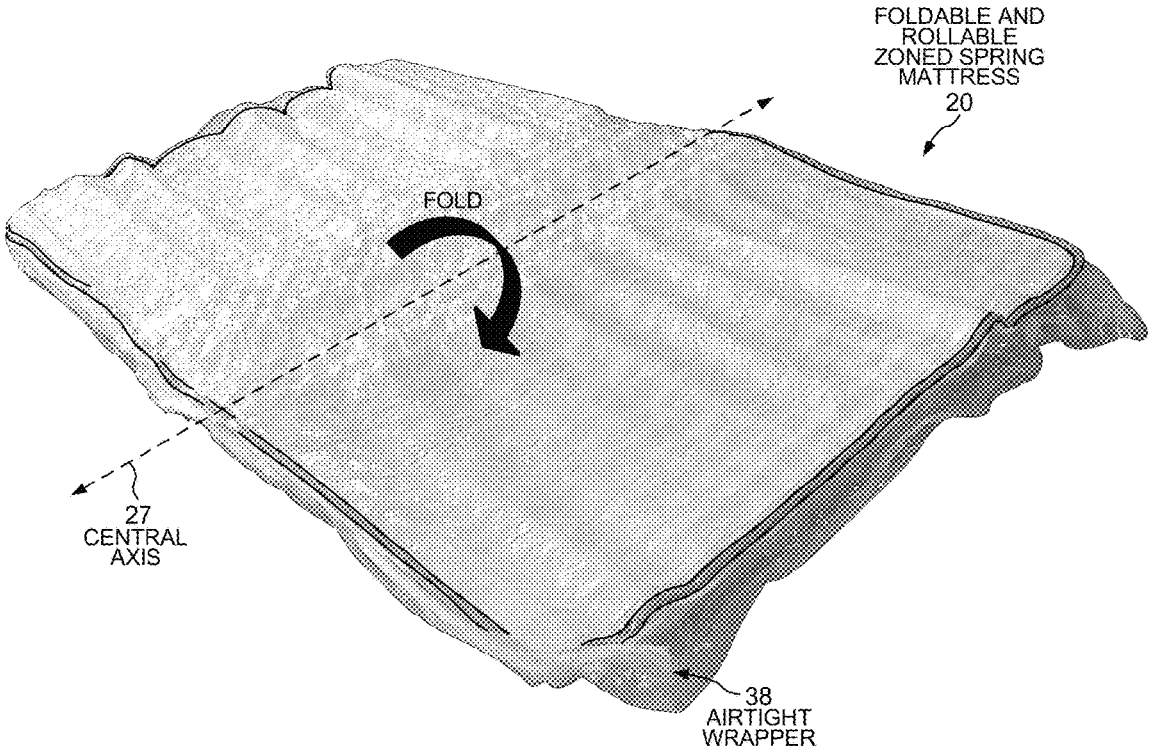
FIG. 12 illustrates where the compressed mattress of FIG. 11 is folded.

In a next step 41, the compressed mattress 20 is folded over itself at the central axis 27. In one embodiment, the upper side 28 of zoned spring layer 21 is folded onto itself. In another embodiment, the lower side 36 of zoned spring layer 21 is folded onto itself. FIG. 12 illustrates step 41 whereby the top half of the upper side of mattress 20 is folded at central axis 27 over onto the bottom half of the upper side of the mattress. The fold passes through the pocket springs 31 of second lateral region 25.

Figure 13:
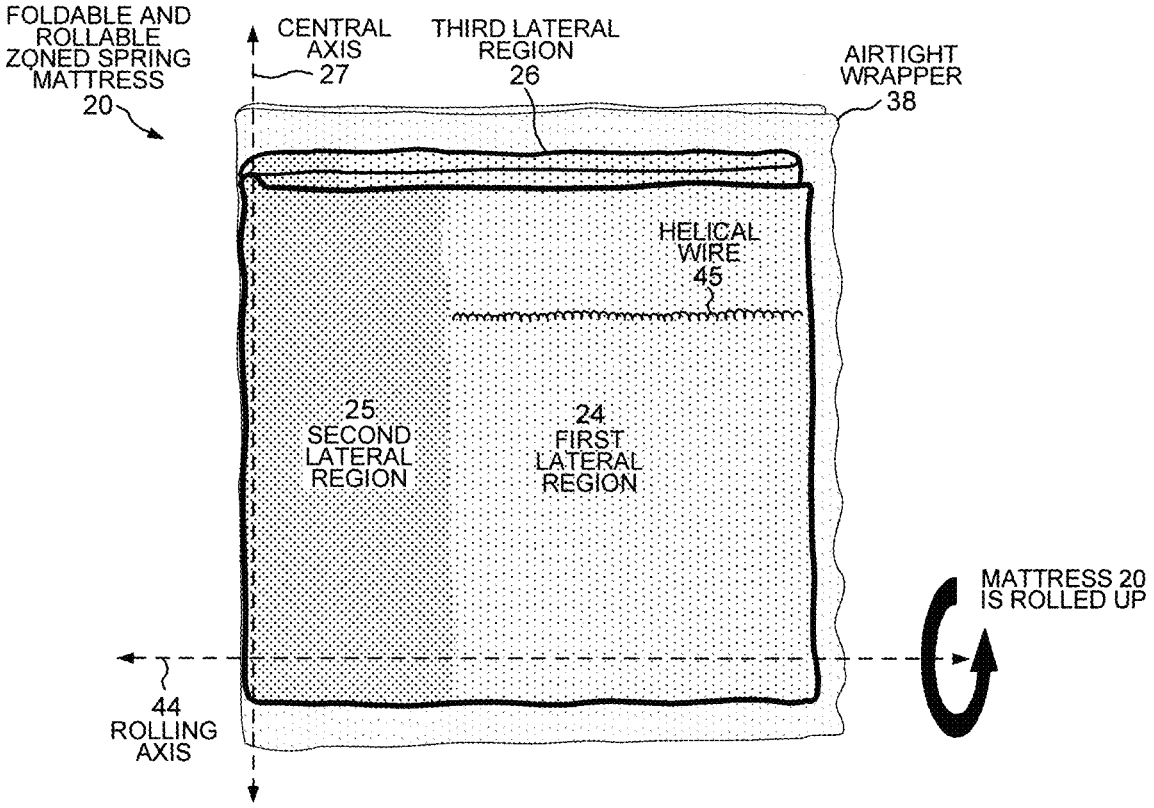
FIG. 13 illustrates how a compressed and folded mattress with coils connected by helical wires is rolled up into a mattress roll.
Figure 14:
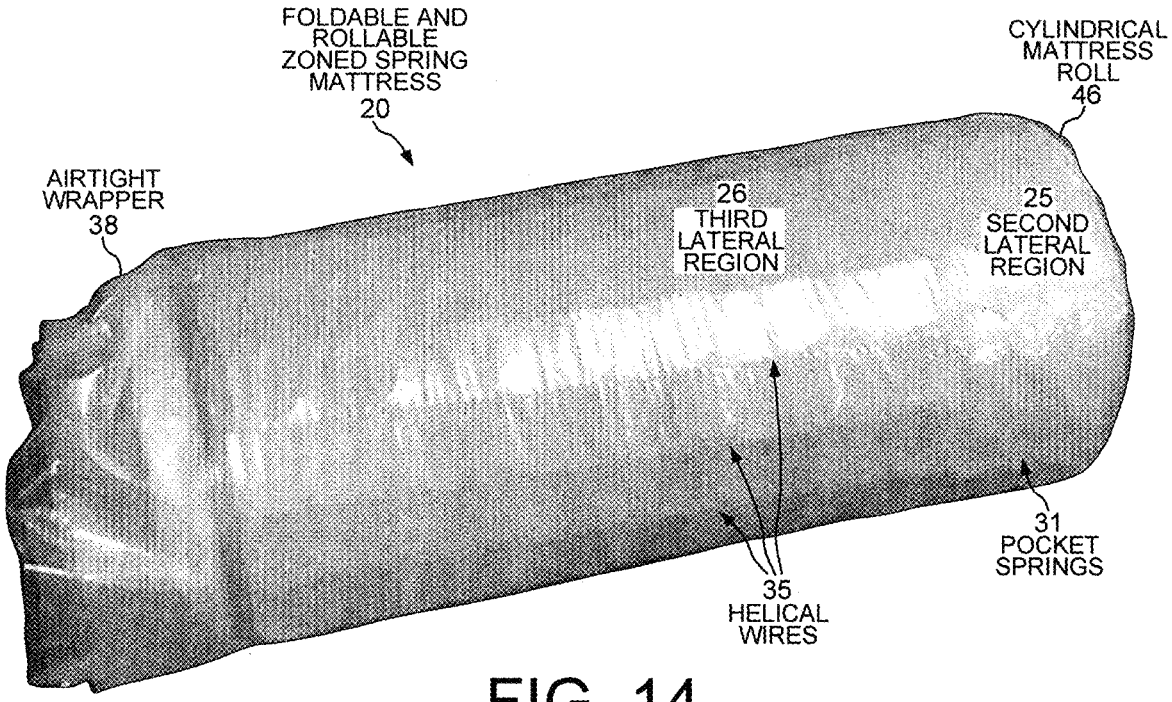
FIG. 14 shows a mattress roll that results when the zoned spring mattress of FIG. 4 is compressed, folded and rolled according to the method of FIG. 10.

In a next step 42, the compressed and folded mattress 20 is rolled about a rolling axis 44 that is perpendicular to the central axis 27. FIG. 13 illustrates step 42 in which the helical-shaped wires 35 are oriented parallel to the rolling axis 44 and remain straight as mattress 20 is rolled up. FIG. 13 shows a representative helical-shaped wire 45, which is not folded or bent as mattress 20 is rolled up. FIG. 14 shows mattress 20 after it has been compressed, folded and rolled into a cylindrical form. The contours formed by some of the helical-shaped wires 35 are visible through the airtight wrapper 38 of the cylindrical mattress roll 46. The circular outlines of some of the pocket springs 31 are also visible through the airtight wrapper 38 of the cylindrical mattress roll 46.

Figure 15:
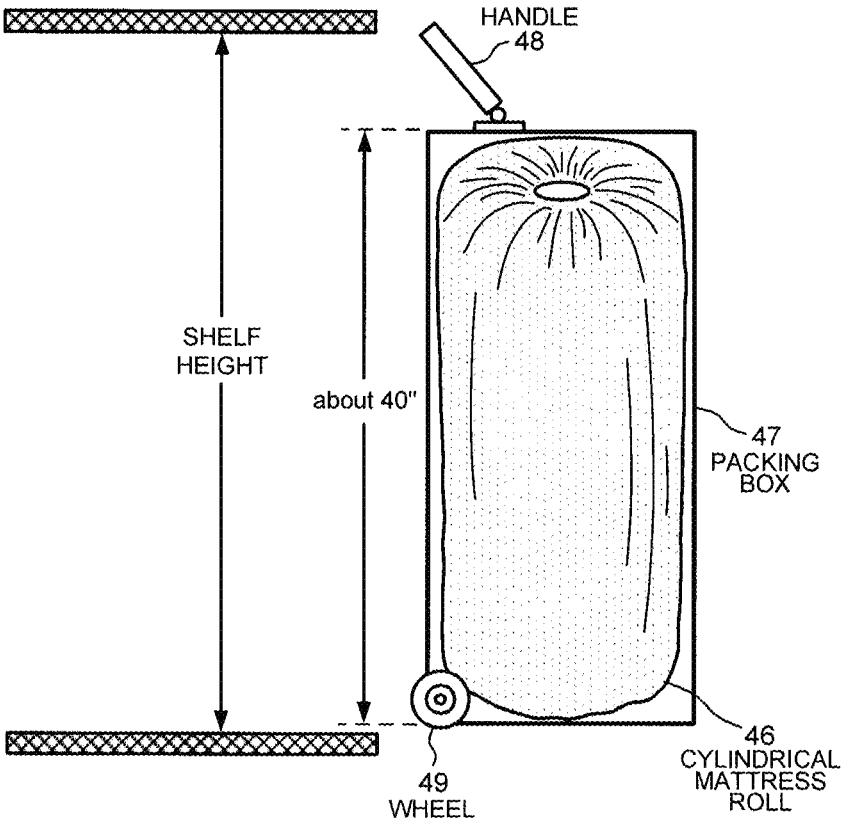
FIG. 15 shows a mattress roll of the zoned spring mattress of FIG. 4 packaged in a packing box.

In a next step 43, the compressed, folded and rolled cylindrical mattress roll 46 in its airtight wrapper 38 is placed in a compact packing box 47. FIG. 15 illustrates queen-size mattress roll 46 after it is packaged in packing box 47 and placed next to store shelving. In one embodiment, packing box 47 is made of cardboard and has a handle 48 and wheels 49. In the embodiment of FIG. 4 in which zoned spring mattress 20 is a queen size mattress with a length of eighty inches, mattress roll 46 is about forty inches long. Consequently, the packing box 47 is slightly taller than the forty-inch mattress roll 46 it must contain. Compact packing box 47 fits upright in a shelf with a shelf height of less than sixty inches, which a boxed, queen-size mattress that is just rolled without first being folded cannot do. Thus, a queen or king size mattress that is compressed, folded, rolled and boxed according to the method of FIG. 10 can be placed upright in the standard shelving of discount retailers.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A mattress comprising:

an upper foam layer with a lower side; and a zoned spring layer with an upper side, a central axis, a top and a bottom, wherein the lower side of the upper foam layer is adjacent to the upper side of the zoned spring layer, wherein the zoned spring layer has a first lateral region, a second lateral region and a third lateral region, wherein the central axis passes through the second lateral region, wherein the first lateral region is disposed between the second lateral region and the top of the mattress, wherein the third lateral region is disposed between the second lateral region and the bottom of the mattress, wherein the second lateral region includes pocket springs comprised of individual metal coils each encased in fabric, wherein the first lateral region and the third lateral region include coils that are connected to one another by helical-shaped wires, wherein the helical-shaped wires are oriented within the first lateral region and the third lateral region longitudinally from the top to the bottom of the mattress, and wherein the metal coils of the second lateral region are made of wire having a smaller gauge than that of the wire from which the coils of the first lateral region and the coils of the third lateral region are made.

2. The mattress of claim 1, wherein the mattress is eighty inches long and sixty inches wide, wherein the first and third lateral regions each has a width of sixty inches, wherein the first lateral region is at least twenty inches long, and wherein the third lateral region is at least thirty inches long.

3. The mattress of claim 1, wherein the first lateral region and the third lateral region include Bonnell springs.

4. The mattress of claim 1, wherein the first lateral region and the third lateral region include continuous coils.

5. The mattress of claim 1, wherein the metal coils of the second lateral region are made of wire having a diameter of 2.0 millimeters or less, and wherein the coils of the first lateral region and the third lateral region are made of wire having a diameter greater than 2.0 millimeters.

6. The mattress of claim 1, further comprising:

a mattress cover that encloses the upper foam layer and the zoned spring layer.

7. The mattress of claim 6, wherein the upper foam layer is integrated into the mattress cover.

8. A mattress comprising:

a first lateral region of a spring layer, wherein the first lateral region comprises coils that are connected to one another by helical-shaped wires;

a second lateral region of the spring layer, wherein the second lateral region comprises individual coils each enclosed in a fabric pocket, wherein a central axis of the mattress passes through the second lateral region, wherein the mattress has a top, a bottom, an upper side and a lower side;

a third lateral region of the spring layer, wherein the third lateral region comprises coils that are connected to one another by helical-shaped wires, wherein the helical-shaped wires are oriented within the first lateral region and the third lateral region longitudinally from the top to the bottom of the mattress, wherein the third lateral region is disposed between the second lateral region and the bottom of the mattress, wherein the first lateral region is disposed between the second lateral region and the top of the mattress, and wherein the coils of the second lateral region are made of wire having a smaller gauge than that of the wire from which the coils of the first lateral region and the coils of the third lateral region are made; and a mattress cover that entirely encloses the first lateral region, the second lateral region and the third lateral region.

9. The mattress of claim 8, further comprising:

an upper foam layer disposed between the mattress cover and the first, second and third lateral regions.

10. The mattress of claim 8, wherein the mattress has a length of eighty inches and a width of sixty inches, wherein the first and third lateral regions are each sixty inches wide, wherein the first lateral region is at least twenty inches long, and wherein the third lateral region is at least thirty inches long.

11. The mattress of claim 8, wherein the first lateral region and the third lateral region include Bonnell springs.

12. The mattress of claim 8, wherein the first lateral region and the third lateral region include continuous coils.

13. The mattress of claim 8, wherein the metal coils of the second lateral region are made of wire having a diameter of 2.0 millimeters or less, and wherein the coils of the first lateral region and the third lateral region are made of wire having a diameter greater than 2.0 millimeters.

14. The mattress of claim 8, wherein no border rod runs laterally along the upper side at the top of the mattress.

15. A method comprising:

compressing a mattress that has a zoned spring layer, wherein air is removed from an airtight wrapper surrounding the mattress as the mattress is compressed, wherein the zoned spring layer has a central axis, a top, a bottom, a first lateral region, a second lateral region and a third lateral region, wherein the central axis passes through the second lateral region, wherein the first lateral region is disposed between the second lateral region and the top of the mattress, wherein the third lateral region is disposed between the second lateral region and the bottom of the mattress, wherein the second lateral region includes pocket springs comprised of individual metal coils each encased in fabric, wherein each of the first and third lateral regions includes coils that are connected to one another by helical-shaped wires, wherein the helical-shaped wires are oriented within the first and third lateral regions longitudinally from the top to the bottom of the mattress, and wherein the metal coils of the second lateral region are made of wire having a smaller gauge than that of the wire from which the coils of the first lateral region and the coils of the third lateral region are made;

folding the compressed mattress over itself at the central axis; and rolling the compressed and folded mattress about a rolling axis that is perpendicular to the central axis, wherein the helical-shaped wires are oriented parallel to the rolling axis.

16. The method of claim 15, wherein the mattress includes a foam layer disposed above the zoned spring layer.

17. The method of claim 15, wherein the mattress is eighty inches long and sixty inches wide, wherein the first and third lateral regions each has a width of sixty inches, wherein the first lateral region is at least twenty inches long, and wherein the third lateral region is at least thirty inches long.

18. The method of claim 15, wherein the first lateral region and the third lateral region include Bonnell springs.

19. The method of claim 15, wherein the first lateral region and the third lateral region include continuous coils.

20. The method of claim 15, wherein the metal coils of the second lateral region are made of wire having a diameter of 2.0 millimeters or less, and wherein the coils of the first and third lateral regions are made of wire having a diameter greater than 2.0 millimeters.

21. The mattress of claim 1, wherein the second lateral region is softer than the first lateral region and the third lateral region.

22. The mattress of claim 1, wherein the third lateral region includes no border wire extending laterally along the bottom of the mattress.

23. The mattress of claim 8, wherein no border wire extends laterally along the bottom of the mattress.

* * * * *